United States Patent [19]

Grummich

[11] 4,375,925

[45] Mar. 8, 1983

[54] BOOK BINDING

[76] Inventor: Hugo Grummich, 532 Wellesley Dr., Cincinnati, Ohio 45224

[21] Appl. No.: 218,840

[22] Filed: Dec. 22, 1980

[51] Int. Cl.[3] ..... B42F 13/06

[52] U.S. Cl. ..... 402/15; 281/23; 402/22

[58] Field of Search ..... 402/5, 8, 20, 22, 13, 402/14, 15; 281/22, 23

[56] References Cited

U.S. PATENT DOCUMENTS

| | | | |
|---|---|---|---|
| 1,926,490 | 9/1933 | Levinsky | 402/22 |
| 2,007,763 | 7/1935 | Klein | 402/75 |
| 2,329,786 | 9/1943 | Ringler | 307/150 |
| 4,135,832 | 1/1979 | Saltz | 402/15 |

FOREIGN PATENT DOCUMENTS

| | | | |
|---|---|---|---|
| 246096 | 3/1966 | Austria | 402/8 |

*Primary Examiner*—Paul A. Bell
*Assistant Examiner*—John S. Brown
*Attorney, Agent, or Firm*—Wood, Herron & Evans

[57] ABSTRACT

An improved book binding for heavy or bulky pages includes a binding member having a base strip and perpendicularly extending flexible fingers. The base strip and opposite finger ends are secured to the book near the flexible spine while the fingers provide flexible page holding portions which can flex with the spine to expand and contract in accommodating varying numbers of pages. Flexible binding flanges in several embodiments serve to connect the binding element to the book so the covers can be opened and closed independent of the flanges and the binding member.

6 Claims, 5 Drawing Figures

BOOK BINDING

This invention relates to book binding and more particularly, to the binding of large or bulky page items such as used in photograph albums, collection mounting books, braille books for the blind and the like.

The binding of such items presents unique problems not particularly pertinent to normally bound flat materials such as normal book pages. For example, it is generally desirable to provide such bulky page items in a binding which will permit them to lay flat when the book is opened. The typical page stiffness, as compared to the relatively more flexible pages of normal books, must be overcome to permit such lay-flat quality.

Moreover, if the page edges of the bulkier-type pages were compressed for binding, the unbound portion, plus the thickness of the material on the pages, tends to expand and to hold the book in an open or fanned-out position.

Also, it is frequently desirable to provide an add-on capability so that extra pages can be added to a particular book. Where the book has a stiff binding, some space within may be left for add-on capability, however, the closed book always occupies essentially the same maximum storage space for its spine whether full, partially full or empty. It is desirable to produce a book having an add-on capability but which has an expandable spine to accommodate its pages without requiring more storage space than is necessary.

Accordingly, it has been one objective of the invention to provide an improved book binding and cover.

A further objective of the invention has been to provide a flexible book binding apparatus with lay-flat capability and cooperating with a flexible book spine to contract or expand, depending on the volume of the pages actually bound at any time.

A further objective of the invention has been to provide an improved book binding wherein the page securing structure thereof is mounted essentially independent of the book spine and of the opened or closed cover position, in order to promote lay-flat quality of the book when used with bulky pages, yet also permitting connection of the binding apparatus to the book without fasteners extending into the cover in some embodiments, or through the cover in others.

To these ends, a preferred embodiment of the invention comprises a book having front and back covers, a flexible spine, pages with securement slots proximate binding edges thereof, and a flexible binding member having a base strip and integral flexible page holding fingers extending perpendicularly therefrom. Preferably, the book includes at least one binding flange extending from the juncture of one cover of the book and the spine, and either the base strip or the loose finger ends are attached to the binding flange while the other of the base strip or loose finger ends are attached to the opposed cover.

Alternately, two binding flanges extend from the respective junctures of the spine with the covers and are provided to enhance lay-flat qualities of the book while maintaining the binding member independent of the cover and spine.

The binding member is preferably made from flexible plastic material and flexes with the book spine so that the spine dimension of the book is expandable and contractible, depending on the volume of pages bound therein.

While the binding member can be secured directly to the book's covers, use of one or both binding flanges renders the cover position independent of the binding apparatus, permitting lay-flat of the book when it is opened, while providing a securement element for the binding member. This permits use of brads, clamps, rivets, screws, snaps or other fasteners into the flanges without detracting from the book's appearances by sticking into or through its cover. The improved binding apparatus provides, when reusable fasteners are used, a loose-leaf or add-on capability as well.

Finally, it will be appreciated that the invention provides a binding member which can flex away from the spine when the book is opened so as to permit the pages to move apart and to lay flat.

These and other objectives and advantages will become readily apparent from the following detailed description of the preferred and alternative embodiments of the invention and from the drawings in which.

Figure 1:
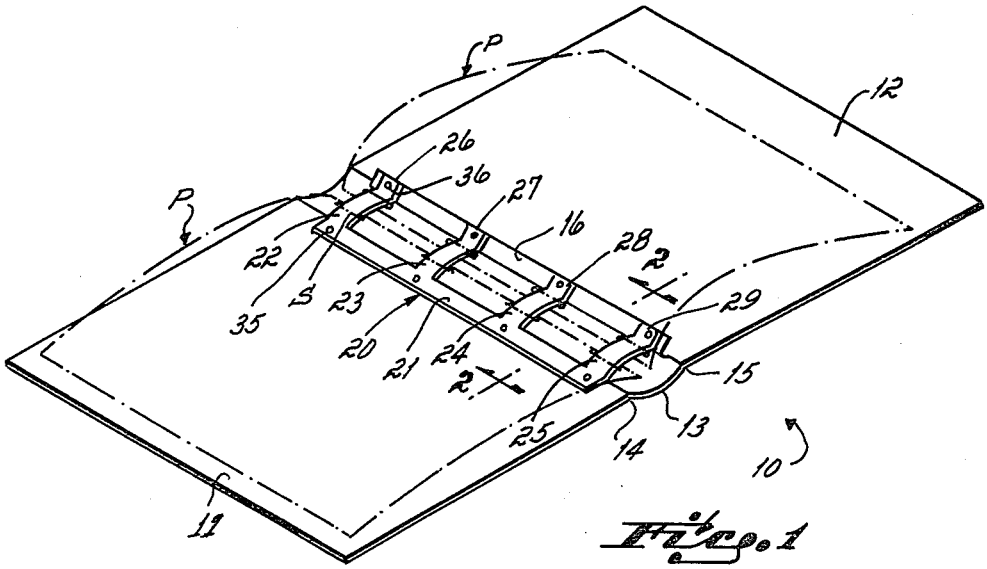
FIG. 1 is a perspective view of a preferred embodiment of the invention in an open condition.

Turning now to FIG. 1, an improved book binding according to the invention is shown therein. In particular, a book 10 is provided with a front cover 11 and a back cover 12. The front and back covers 11 and 12 are joined together by a flexible spine 13 extending between inner edges of the covers. The spine 13 is joined to the cover 11, along junction line 14 and to the cover 12 along junction line 15. A binding flange 16 is secured to the back cover 12 of the book 10 along the junction line 15 such that the binding flange 16 is flexible with respect to both the cover 12 and the flexible spine 13.

The book 10 is particularly adapted to secure or to bind therein heavy bulky pages such as those shown in phantom and indicated by the letter "P" in FIG. 1. Such pages may be the heavy board normally used in braille books, cardboard for photo or collection albums, or the like. Each of the pages has a plurality of elongated slots "S" which are disposed proximate the bound edges of the pages as shown in FIGS. 1 and 2, for example.

A binding member 20 is provided to secure the pages within the book 10. Binding member 20 is preferably made from a plastic material which is thin, flat and flexible. The binding member 20 includes a base strip 21 and a plurality of page holding fingers 22 through 25 extending integrally and generally perpendicularly therefrom. Each of the fingers has a loose end such as shown at 26 through 29, which constitutes that part of the finger opposite of the base strip 21.

Moreover, each of the fingers is preferably scored along scorelines, such as those indicated at 31 and 32 (FIG. 2), to define between such scorelines, a page holding portion 33 of definite dimension in each finger. When the binding member is in place, the pages are secured between the scorelines 31 and 32 on the page holding portion 33 of each finger.

Figure 2:
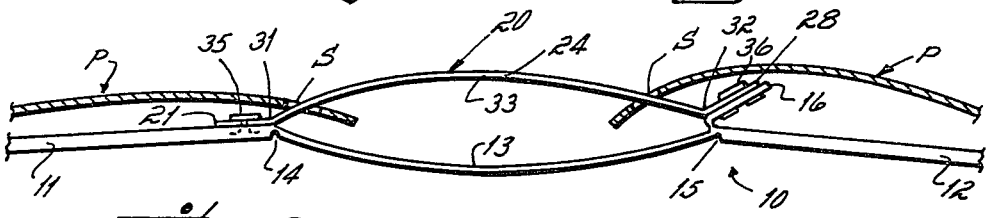
FIG. 2 is a cross-sectional view taken along the lines 2—2 of FIG. 1.

As shown in FIG. 2, the binding member is preferably secured so as to span the spine 13 of the book. More particularly, the base strip 21 of the binding member 20 is permanently secured, as by a rivet or a staple 35, to cover 11 of the book as shown. This particular staple or fastener 35 is provided such that it does not extend totally through the cover of the book, although it is secured into the cover 11.

The loose ends 26 through 29 of the fingers are secured on the other side of the spine 13 to the binding flange 16, also by means of a staple, brad or other type fastener 36 which extends through the binding flange 16. Alternately, a removable screw such as that shown at 37 in FIG. 5 could be utilized in order to provide an add-on capability for the book 10. Of course, any suitable permanent or removable fastener could be utilized in this connection, dependent on the nature of the book desired.

It should be appreciated, of course, that the loose ends of the fingers are secured to the book by means of the binding flange 16, and that the fastener apparatus, whatever it is, does not extend through the cover of the book. Accordingly, it will be appreciated that the loose ends of the fingers are attached to the binding flange 16 such that the binding member 20 is totally independent of the cover 12. Moreover, it is not necessary for the fastener 36 to extend through the cover 12 or into the cover 12.

Figure 3:
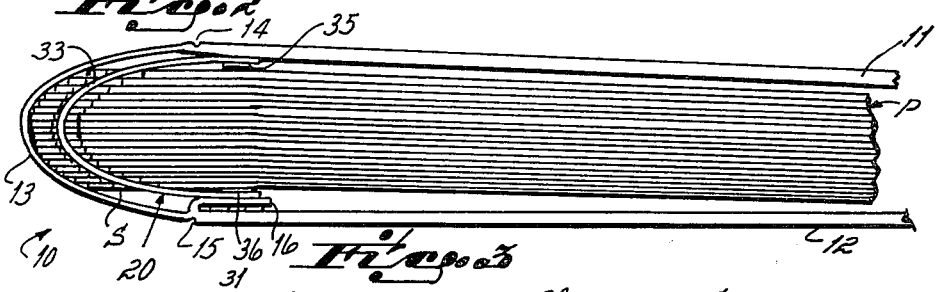
FIG. 3 shows the embodiment of FIG. 2 in closed condition.

When the book is closed as shown in FIG. 3, the spine 13 is totally free to flex outwardly, depending on the thickness of the materials which are actually bound in the book. If not many materials are bound in the book, the spine 13 can substantially flex in an outwardly direction about junction lines 14 and 15. In this connection, it will be appreciated that the flexibility of the binding member 20, and particularly that of the page holding portions 33, also permits the entire book to be collapsed or contracted in the spine area, the page holding portions 33 also bending and extending outwardly and away from the book in conformity with the flexible spine 13. Accordingly, the spine dimension of the book is not constant, but rather is a variable depending on the number of pages bound within the book. The spine dimension may thus expand and contract to accommodate varying numbers of pages.

Upon opening, the page holding portions 33 flex inwardly away from the spine. This permits the pages to separate and to lay flat on the opened covers.

Figure 4:
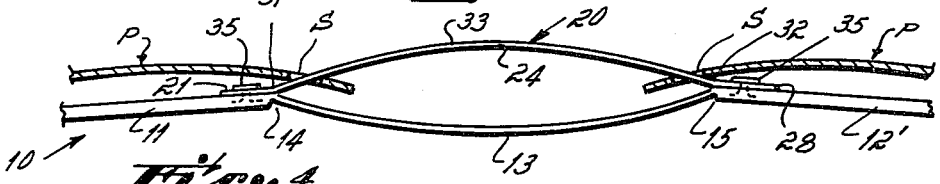
FIG. 4 is a cross-sectional view similar to FIG. 2, but showing an alternative embodiment of the invention.

FIG. 4 discloses a cross-section of an alternative embodiment of the invention wherein no binding flange 16 is utilized, but rather wherein the binding member 20 is secured directly into the front cover 11 and the rear cover 12' adjacent the spine of the book. In FIG. 4, elements thereof which are the same as the elements as shown in FIG. 2 are designated with like numbers, while the elements which differ slightly are designated by like primed numbers.

Respecting FIG. 4, it will be appreciated that the binding member is not totally independent of the covers of the book, since the binding member is secured to the covers. Nevertheless, it is this embodiment which provides the maximum lay-flat capability of the pages "P" and the book cover. In FIG. 2, for example, it will be appreciated that the binding flange 16 provides a slight impediment to the absolute lay-flat of the page "P" thereabove. In the embodiment shown in FIG. 4, however, it will be appreciated that the pages are permitted to lie substantially flat along with the covers 11 and 12' of the book, the binding member 20 simply being attached to the cover. Of course, it will also be appreciated that the fasteners 35 do not extend all the way through the covers, but rather into the cover so that the appearance of the outer cover portion is not interrupted by the fastener.

Figure 5:
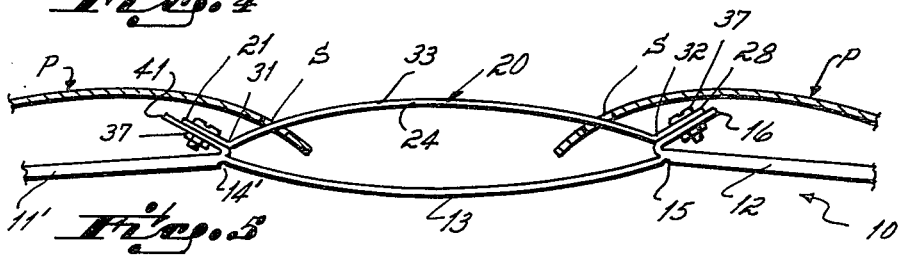
FIG. 5 is also a cross-sectional view similar to FIG. 2 but showing a still further alternative embodiment of the invention.

FIG. 5 depicts a further alternative embodiment of the invention. Similar parts to those of FIGS. 1 and 2 are similarly designated while primed numbers are used for differing elements. The alternative embodiment shown in FIG. 5 is somewhat similar to that of FIG. 2, however, it will be appreciated that an additional binding flange 41 is secured to the book cover 11' along the junction 14' of the cover 11' with the spine 13. The binding flange 41 is essentially similar to the binding flange 16, which is associated with rear cover 12 of the book. In this embodiment, the base strip 21 is secured to the binding flange 41 near the front cover of the book, while the loose ends of the fingers, such as loose end 28 of the finger 24 is secured to the binding flange 16. Such construction permits the covers 11' and 12 to lay substantially flat on any supporting surface. While the binding flanges 16 and 41 are disposed between the outermost pages and the covers when the pages are open, they do not significantly interfere with the capability of the pages to lie flat when the book is open. Moreover, they of course provide full means for securing the binding member to the book by means of fasteners which do not extend either into or through the covers 11' and 12. Of course, when removable fasteners, such as screws 37 are utilized, the book as depicted in FIG. 5 is capable of operating in a loose leaf or add-on fashion, and the pages can be added or removed therefrom.

The embodiments as shown in FIGS. 4 and 5 obtain many of the features that have been discussed with respect to the embodiment shown in FIGS. 1 and 2. In particular, the page holding portion 33 of the fingers is flexible and can flex with the spine 13 to accommodate varying numbers of pages within the book, and to permit the spine dimension to contract or expand, depending on the volume of pages which are actually secured into the book. Moreover, each of the fingers of the embodiment of FIGS. 4 and 5 are also scored in the same positions to enhance the independent movement of the covers with respect to the page holding portions 33 of the fingers. Accordingly, while the dimension of the page holding portion of the fingers between the scores always remains constant, the fingers are nevertheless flexible, bending to accommodate varying number of pages, and permitting full extension when the book is opened into a lay-flat position in order to promote lay-flat of the pages therein.

Accordingly, it will be appreciated that the embodiments of FIGS. 1 and 2, and of FIG. 5 differ slightly from the embodiment of FIG. 4 which has no binding flange. While the embodiment of FIG. 4 thus permits the pages to lay a slight bit flatter than the remainder of the embodiments, the page holding elements of FIG. 4 are secured directly to the covers of the book. This may tend to present a slightly stiffer binding until the book is "worked" or opened and closed several times to loosen or limber-up the score areas of the binding member 20. The embodiments of FIGS. 1, 2 and 5 tend to be slightly more flexible on opening and closing as a result of the independent connection provided by the binding flanges between the binding member 20 and the book covers.

Nevertheless, each of the embodiments provides substantial advantages in that they all permit lay-flat qualities of heavy, bulky and permanently or removably bound pages, while maintaining a flexible spine and the contractibility or expansibility that a flexible spine provides. Moreover, it will be appreciated that the binding members 20 can be very inexpensively made, and readily adaptable to uses requiring more or less fingers than those shown in the drawings. It will be further appreciated that each embodiment of the invention permits the page holding portion of the fingers to move away from the spine when the book is opened (FIGS. 2, 4 and 5). This permits the pages to move apart from each other and to lay flat when the book is opened. The page holding portion thus bends or moves toward and with the spine when the book is closed (FIG. 3, for example) permitting spine contraction, and moves away from the spine as the book is opened to enhance its lay-flat qualities.

These and other advantages, embodiments and alterations will become readily apparent to one of ordinary skill in the art without departing from the scope of this invention, and the applicant intends to be bound only by claims appended hereto.

I claim:

1. In a book having a flexible spine joining front and back covers and pages having elongated apertures proximate edges thereof for binding within the book, flexible binding apparatus comprising:

an integral flexible binding member having an elongated base strip and a plurality of flexible page holding fingers integral with the base strip and extending perpendicularly therefrom;

means in said base strip proximate respective fingers for connecting said base strip to one cover of said book;

means proximate loose ends of said fingers opposite said base strip for connecting said fingers to another cover of said book across said spine;

said fingers extending through said page apertures binding said pages between said covers;

said binding member being made of flexible plastic material and each of said fingers of said binding member from adjacent said base strip and toward said loose ends of the fingers defining a flexible page holding portion of constant dimension, said base strip and said loose ends being connected to said respective covers, outwardly of said page holding portion; and said page holding portions bending with said spine when said book is closed and bending away from said spine when said book is opened.

2. Apparatus as in claim 1 further including:

A first binding flange extending flexibly from one cover of said book proximate its juncture with the spine thereof, and wherein one of said loose ends of said fingers and said base strip are secured to said binding flange, while the other of said loose ends of said fingers and said base strip are secured to the other cover of said book.

3. Apparatus as in claim 1 wherein said respective connecting means include a first binding flange extending from one cover of said book proximate its juncture with said spine, and a second binding flange extending from another cover of said book proximate its juncture with said spine, and wherein said base strip is secured to said first flange and said loose ends of said fingers are secured to said second flange.

4. Apparatus as in claim 3 wherein said binding flanges are flexible along their juncture with said covers, said covers being movable between open and closed positions independent of the position of said flanges.

5. Apparatus as in claims 2 or 3 wherein said book can be opened into a lay-flat condition, both covers being flatly disposed in essentially the same plane, and the pages thereof lying in essentially an open, flat position.

6. Apparatus as in claim 1 wherein said base strip and said loose ends of said fingers are secured directly to respective covers of said book.

* * * * *